United States Patent [19]

Asano et al.

[11] 4,123,896

[45] Nov. 7, 1978

[54] DIGITAL ELECTRONIC TIMEPIECE

[75] Inventors: Kazuhiro Asano; Takehiro Ishikawa; Kazumasa Yasuda; Takashi Ishijima, all of Tokyo, Japan

[73] Assignee: Kabushiki Kaisha Daini Seikosha, Japan

[21] Appl. No.: 731,108

[22] Filed: Oct. 8, 1976

[30] Foreign Application Priority Data

Oct. 9, 1975 [JP] Japan ..... 50-121992

[51] Int. Cl.[2] ..... G04F 3/06

[52] U.S. Cl. ..... 58/39.5; 58/22.9; 235/92 T; 324/186

[58] Field of Search ..... 58/21.13, 22.9, 23 R, 58/39.5, 50 R, 85.5, 152 R; 235/92 T; 324/186

[56] References Cited

U.S. PATENT DOCUMENTS

| | | | |
|---|---|---|---|
| 3,813,533 | 5/1974 | Cone et al. | 58/50 R |
| 3,854,277 | 12/1974 | Samejima et al. | 58/152 R |
| 3,992,871 | 11/1976 | Numabe | 58/39.5 |
| 4,005,571 | 2/1977 | Wolff | 58/39.5 |

*Primary Examiner*—Edith S. Jackmon

*Attorney, Agent, or Firm*—Robert E. Burns; Emmanuel J. Lobato; Bruce L. Adams

[57] ABSTRACT

A digital electronic timepiece has normal time counting means and also a different time counting means, for example for local time in a different time zone or country. Electronic switching is provided for selectively displaying either the normal time or the different time. Each of the time counting means includes up-counting means and down-counting means so that under the control of corresponding setting means the time of either the normal time counting means or the different time counting means can be amended either upwardly or downwardly.

5 Claims, 4 Drawing Figures

DIGITAL ELECTRONIC TIMEPIECE

FIELD OF INVENTION

The present invention relates to a digital electronic timepiece and in particular to a timepiece having normal time counting means and different time counting means with means for selectively displaying either the normal time or the different time. The invention further relates to setting means which permit the time to be amended either upwardly or downwardly.

BACKGROUND OF INVENTION

The conventional type of digital electronic timepiece is composed of an oscillating circuit, a dividing circuit, a ten minutes counter, an hour counter, a twelve hours counter, a time display and driving circuits for the display. The time display is restricted to the normal time display and does not include means for displaying the local time in a different country or different time zone.

Moreover, in the conventional construction, the time setting means provides means for amending the time in a forward direction by increasing the count of the time counting means. It is impossible to attain downward amendment of the time display. Hence, if it is desired to amend the time for a short time in a downward or backward direction, it is necessary to operate the time setting switch many times in order to cause the counting means to make an almost complete circuit.

SUMMARY OF INVENTION

The present invention aims to eliminate the above noted difficulties and insufficiencies of conventional electronic timepieces. In accordance with the invention, there is provided not only the normal time counting means but also a different time counting means for the time in a different country or different time zone, switching means being provided so that either the normal time or the local time can be displayed as desired.

Moreover, each of the time counting means includes up-counting means and down-counting means and the time setting means correspondingly includes means for selectively actuating either the up-counting means or the down-counting means so that the time can be amended either upwardly or downwardly as desired.

BRIEF DESCRIPTION OF THE DRAWINGS

The nature, objects and advantages of the invention will be more fully understood from the following description in conjunction with the accompanying drawings, in which.

DESCRIPTION OF CONVENTIONAL CONSTRUCTION

Figure 1:
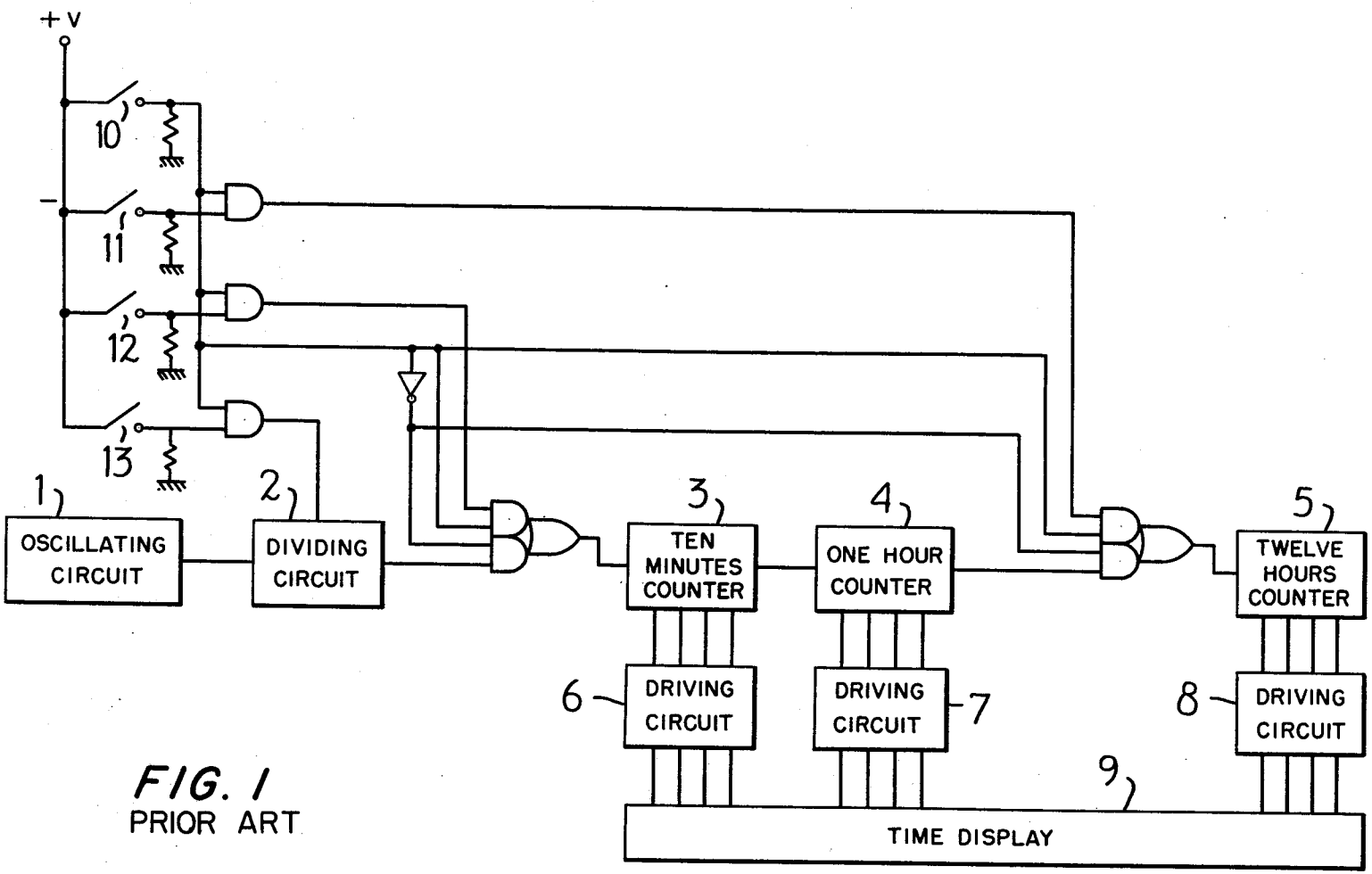
FIG. 1 PRIOR ART
FIG. 1 is a circuit diagram of a digital electronic timepiece of the conventional type.

As shown by way of example in FIG. 1, a conventional electronic timepiece is composed of an oscillating circuit 1, a dividing circuit 2, a ten minutes counter 3, a one hour counter 4, a twelve hours counter 5 and driving circuits 6, 7 and 8 for a display portion 9. Amendment of the time display 9 is attained by means of time amending switches 10, 11, 12 and 13. Amendment can be made only in a forward or upward direction by increasing the count of the respective counters. There is no provision for amending the time in a downward direction.

Moreover, the conventional digital electronic timepiece has only a single time counting means for counting the normal time. Hence, if it is desired to know the time in a different country or different time zone, this must be done by mental calculation. Alternatively, the counting means and time display must be reset whereupon the original time is lost.

DESCRIPTION OF PREFERRED EMBODIMENT

Figure 2:
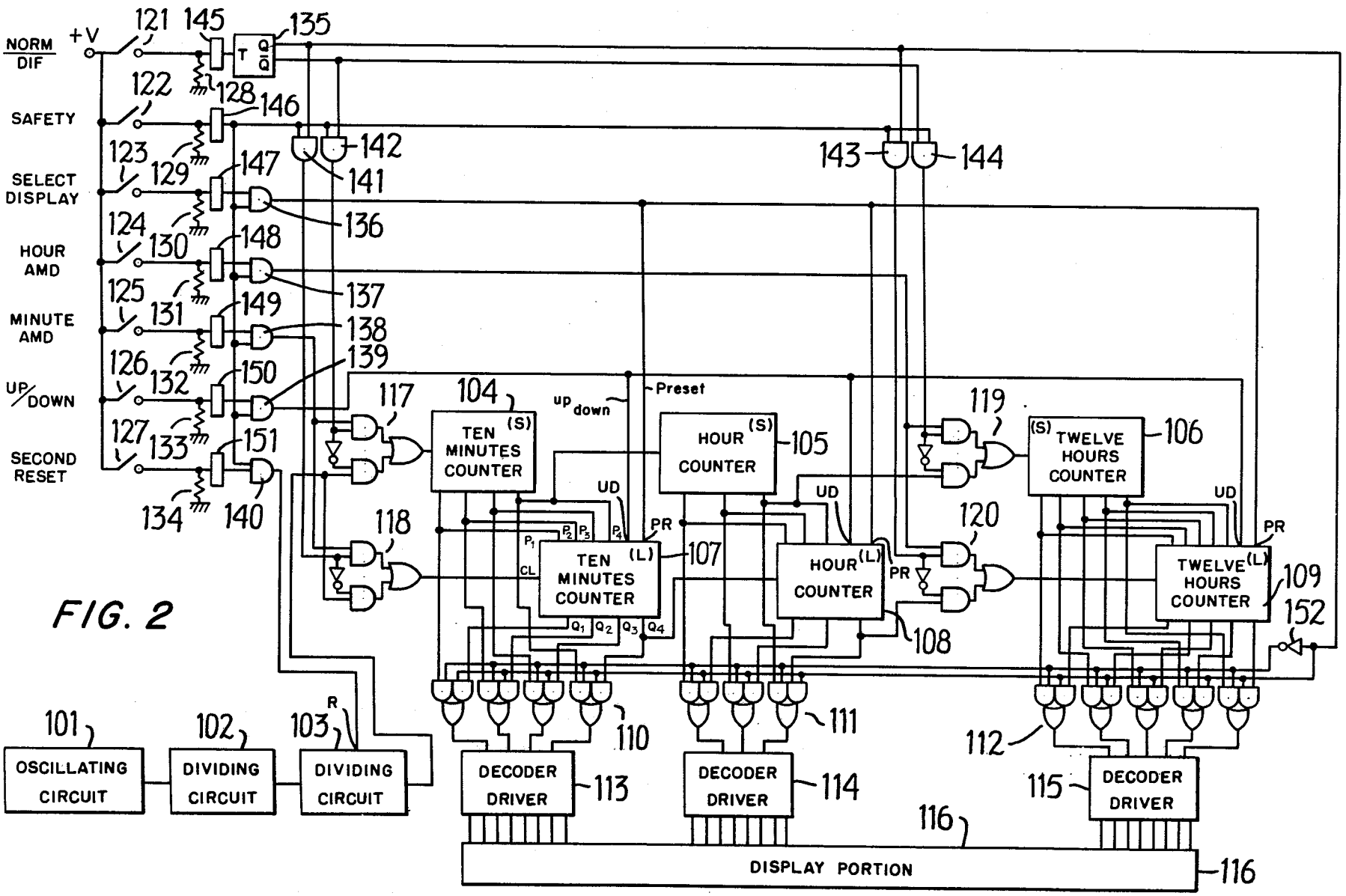
FIG. 2 is a circuit diagram of a digital electronic timepiece in accordance with the present invention.

In FIG. 2 there is shown the circuit of an electronic timepiece in accordance with the present invention. The circuit comprises an oscillating circuit 101, the output of which is connected to a dividing circuit 102. The output of the dividing circuit 102 is applied to a second dividing circuit 103 which provides a time standard signal of the desired frequency.

The output of the dividing circuit 103 is applied to a ten minutes counter 104 of a first time counting circuit through a first electronic switch 117. The output of the minutes counter 104 is applied to a 1 hour counter 105. The output of the 1 hour counter 105 is applied to a 12 hours counter 106 through a second electronic switch 119. The counters 104, 105 and 106 comprise the normal time counting circuitry of the timepiece.

A second time counting circuit comprises a 10 minutes counter 107, a 1 hour counter 108 and a 12 hours counter 109. The output of the dividing circuit 103 is applied to the 10 minutes counter 107 through a third electronic switch 118. The output of the 10 minutes counter 107 is applied to the 1 hour counter 108. The output of the 1 hour counter 108 is applied to the 12 hours counter 109 through a fourth electronic switch 120. The counters 107, 108 and 109 thus provide means for counting a different time, for example the time in a different country or different time zone.

The binary output of the 10 minutes counter 104 is connected to the inputs $P_1$–$P_4$ of the 10 minutes counter 107. The outputs of the ten minutes counters 104 and 107 are respectively connected to a first electronic switch group 110, the output of which is applied to a display portion 116 through a decoding and driving circuit 113.

Similarly, the binary output of the 1 hour counter 105 is connected to the inputs $P_1$–$P_3$ of the 1 hour counter 108. The binary outputs of the 1 hour counters 105 and 108 are applied to a second electronic switch group 111, the output of which is connected to the display portion 116 through a decoding and driving circuit 114.

In like manner, the binary output of the 12 hours counter 106 is connected to the inputs $P_1$–$P_4$ of the 12 hours counter 109. The binary outputs of the 12 hours counters 106 and 109 are applied to a third electronic switch group 112, the output of which is connected to the display portion 116 through a decoding and driving circuit 115.

Each of the counters 107, 108 and 109 includes up-counting means and also down-counting means so that the count of the counters can be amended either upwardly or downwardly by the time setting means described below.

Seven manually operable switches 121, 122, 123, 124, 125, 126 and 127 are provided for controlling the electronic switches 117, 118, 119 and 120 and the electronic switch groups 110, 111 and 112 and for amending the count of the time counters 104, 105, 106, 107, 108 and 109. One terminal of each of the switches 121–127 is connected to the high voltage side of the battery. The other terminals of the switches 121, 122, 123, 124, 125, 126 and 127 are connected through resistors 128, 129, 130, 131, 132, 133 and 134 respectively to the low voltage side of the battery.

The switches 121–127 operate the selection of the various functions of the setting and control means. The first switch 121 makes a selection between the normal time and the different time. The second switch 122 is a safety switch which must be in ON position in order for the other switches to operate. The third switch 123 is a switch for selecting the display. The fourth switch 124 is the hour amending switch while the fifth switch 125 is the minute amending switch. The sixth switch 126 is the selecting switch for counting up or counting down when amending the count of the counters. The seventh switch 127 is a reset switch.

The terminal of switch 121 connected to the resistor 128 is connected through a chattering preventing circuit 145 to a trigger flip-flop 135. The Q output of the trigger flip-flop 135 is connected to one terminal of each of AND gates 141 and 143, the other terminal of which is connected to the safety switch 122. The Q output of the trigger flip-flop 135 is further connected to one control terminal of the first, second and third electronic switch groups 110, 111 and 112 and to the input of an inverter 152. The output of the inverter 152 is respectively connected to the other control terminal of the first, second and third electronic switch groups 110, 111 and 112. The $\bar{Q}$ terminal of the trigger flip-flop 135 is connected to one input of each of AND circuits 142 and 144, the other input of which is connected to the safety switch 122.

The terminal of the second switch 122 connected to the resistor 129 is respectively connected to one input of each of AND gates 136, 137, 138, 139, 140, 141, 142, 143 and 144 through a chattering preventing circuit 146. The output of AND gate 141 is connected to the control terminal of the third electronic switch 118. The outputs of AND gates 142, 143 and 144 are respectively connected to the control terminals of the first, fourth and second electronic switches 117, 120 and 119.

The terminal of the third switch 123 connected to the resistor 130 is connected through a chattering preventing circuit 147 to the other input of the AND gate 136. The output of AND gate 136 is respectively connected to the presetting input terminals PR of 10 minutes counter 107, one hour counter 108 and twelve hours counter 109.

The terminal of the fourth switch 124 connected to the resistor 131 is connected through a chattering preventing circuit 148 to the other input of AND gate 137. The output of AND gate 137 is respectively connected to the other inputs of the second and fourth electronic switches 119 and 120.

The terminal of the fifth switch 125 connected to the resistor 132 is connected to the other input of the AND gate 138 through a chattering preventing circuit 149. The output of the AND gate 138 is connected to the other input of the first and third electronic switches 117 and 118.

The terminal of the sixth switch 126 connected to the resistor 133 is connected to the other input of AND gate 139 through a chattering preventing circuit 150. The output of the AND gate 139 is respectively connected to the up-down control terminals UD of 10 minutes counter 107, one hour counter 108 and twelve hours counter 109.

The terminal of the seventh switch 127 connected to the resistor 134 is connected through a chattering preventing circuit 151 to the other terminal of AND gate 140. The output of the AND gate 140 is connected to the reset terminal R of the dividing circuit 103.

The operation of the digital electronic timepiece of the present invention will now be described. The time standard signal generated by the oscillating circuit 101 is divided to a one minute signal by dividing circuits 102 and 103. All of the outputs of the AND gates 136, 137, 138, 139, 140, 141, 142, 143 and 144 are at low level when all of the switches 121, 122, 123, 124, 125, 126 and 127 are in OFF position. Therefore, the first and third electronic switches 117 and 118 apply the output from the dividing circuit 103 to the 10 minutes counters 104 and 107. The 10 minutes counter 104 is employed for the normal time counter while the ten minutes counter 107 is applied for the different time counter, for example for local time in a different country or different time zone. The information of the 10 minutes counter 104 is applied to the decoding and driving circuit 113 when the Q output of the trigger flip-flop 135 is at low level whereby the ten minutes figure of the normal time is displayed on the display portion 116. On the other hand, the display portion 116 displays the different time when the Q output of the trigger flip-flop 135 is at high level.

Further, the 10 minutes signal generated by the 10 minutes counter 104 is applied to the 1 hour counter 105 and the 1 hour signal generated by the 1hour counter 105 is applied to the twelve hours counter 106 through the second electronic switch 119.

The 10 minutes signal generated by the 10 minutes counter 107 is applied to the 1 hour counter 108. The 1 hour signal generated by the 1 hour counter 108 is applied to the 12 hours counter 109 through the fourth electronic switch 120 whereby the different time, namely local time in a different country or different time zone is counted.

The information in the one hour counters 105 and 108 and the twelve hours counters 106 and 109 is switched by the second and third electronic switch groups 111 and 112 controlled by the Q output of the trigger flip-flop 135 similarly to the case of the ten minutes counters 104 and 107, whereby the normal time and the different time are selectively displayed by the display device 116. Thus, the display switching of normal time and different time is attained by the inverted output of the trigger flip-flop 135 by ON-OFF operation of the first switch 121.

The operation of the time amending circuitry will now be described. The second switch 122 is a safety switch composed of a bistable switch having a mechanical holding means. One input of each of AND gates 136, 137, 138, 139, 140, 141, 142, 143 and 144 becomes to ON condition when the second switch 122 is in ON position. The outputs of AND gates 142 and 144 become high level when the safety switch 122 is in ON position and the Q output of the trigger flip-flop 135 is at low level whereby first and second electronic switches 117 and 119 are switched so that the output of the dividing circuit 103 is not applied to the ten minutes counter 104, the one hour counter 105 and 12 hours counter 106.

On the other hand, the outputs of AND gates 141 and 143 are not changed sofar as the second switch 122 is not operated and accordingly the condition of the third and fourth electronic switches 118 and 120 is not changed whereby the counting operation for the different time is continued normally.

The pulse generated at the output of the AND gate 137 when the safety switch 122 is in ON position and the fourth switch 124 is operated ON and OFF is applied to the 12 hours counter 106 through the second electronic switch 119 whereby fast forward amendment of the counter is effected. Similarly, the fast forward of ten minutes counter 104 and 1hour counter 105 is operated when the fifth switch 125 is operated ON and OFF.

The sixth switch 126 for selecting between up amendment and down amendment of the counters is composed of a bistable switch the same as the second switch 122. The "up" amendment of the different time counters is operated by the fast forward operation when the sixth switch 126 is in OFF position. On the other hand, "down" amendment of the different time counters is operated by the fast forward operation when the switch 126 is in ON position.

The seventh switch 127 is the second resetting switch. The dividing circuit 103 is reset when the switch 127 is operated to ON position. The dividing circuit 103 begins to count when the switch 127 is operated to OFF position.

The third switch 123 is operated to transfer the contents of the normal time counter to the different time counter. When the third switch 123 is operated to ON position the normal time is applied to the preset terminals of the counters 107, 108 and 109 whereby the normal time and different time are set to the same time. Thus, the output of the AND gate 136 becomes high level when the third switch 123 is operated to On position and the preset inputs PR of the 10 minutes counter 107, 1 hour counter 108 and twelve hours counter 109 become high level whereby the information applied to the P-inputs of the counters 107, 108 and 109 from the respective outputs of 0 minutes counter 104, 1 hour counter 105 and 12 hours counter 106 is applied to the counters which are thereby set.

Figure 3:
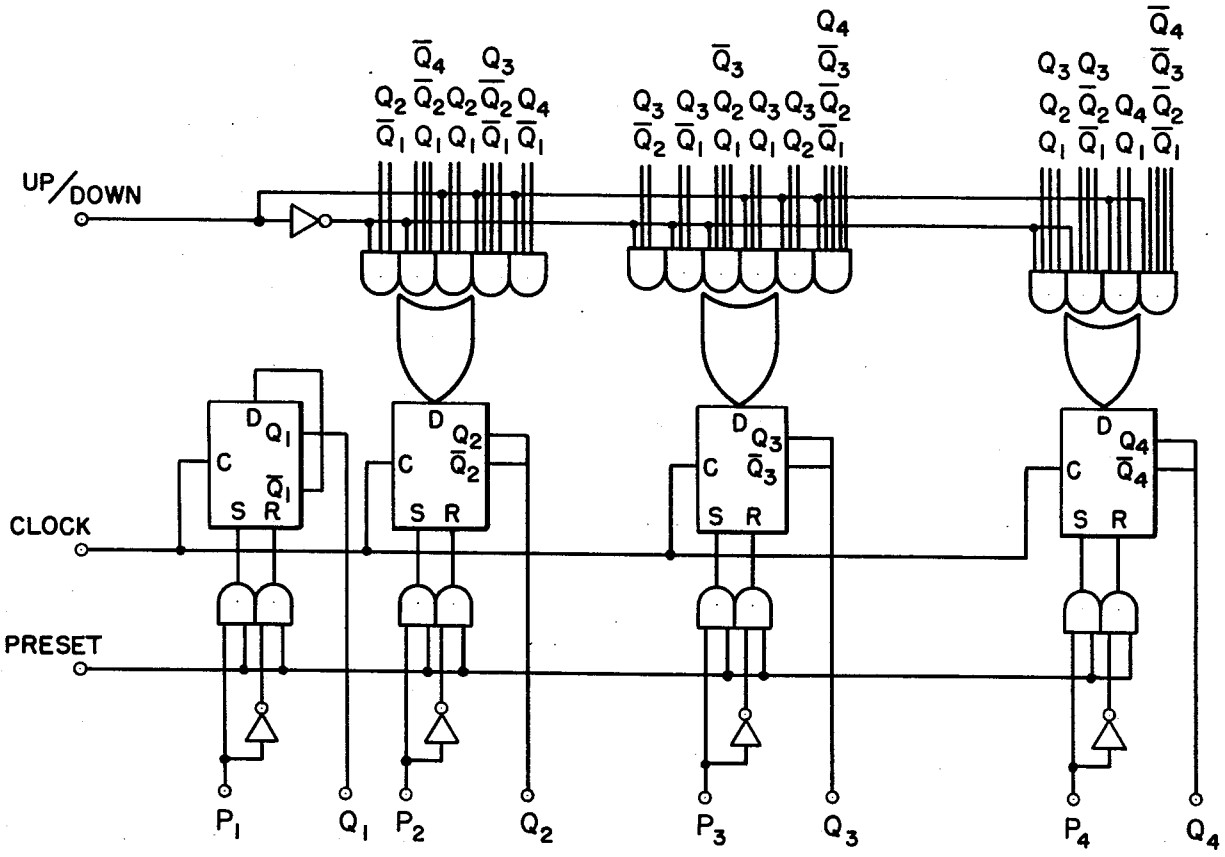
FIG. 3 is a circuit diagram for one of the up-down counters having preset means, the circuit being a part of FIG. 2.

FIG. 3 shows by way of example one embodiment of an up-down counter having a preset function, the embodiment shown being employed as the ten minutes counter 107 for the different time. The other time counters are similarly constructed.

Figure 4:
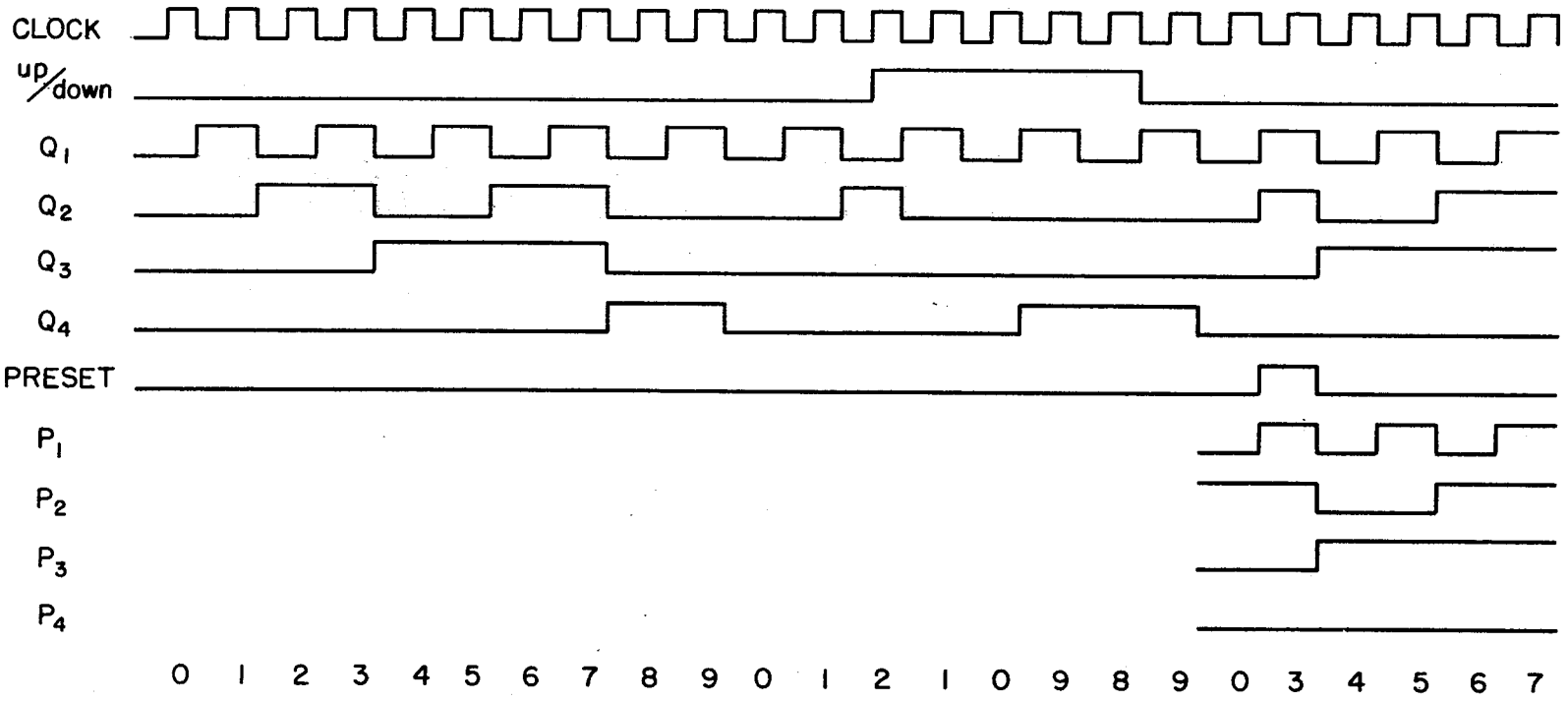
FIG. 4 shows the waveforms of each point of FIG. 3.

FIG. 4 is the time chart illustrating the operation of the up-down counter having a present function as illustrated in FIG. 3. The waveforms at each point of the circuit identified in FIG. 3 are identified by the same reference characters in FIG. 4.

It will thus be seen that according to the present invention the operation of amending the time either up or down is easily effected and it is possible to transfer the normal time display to the different time display. Moreover, it is possible selectively to display either the normal time display or the different time display as desired. Thus, for example when a person having a timepiece in accordance with the invention is traveling, the normal time display can be left unchanged while the different time display is amended to the local time of the country or area being visited.

While a preferred embodiment of the invention has been illustrated by way of example in the drawings and is herein particularly described, it will be understood that the invention is in no way limited to this embodiment since many variations and modifications may be made.

What we claim is:

1. A digital electronic timepiece comprising means for generating a time standard signal, frequency dividing means for dividing said time standard signal to produce a divided signal, first time counting means for counting said divided signal to generate a first time signal, second time counting means for counting said divided signal to generate a second time signal said second time counting means comprising an up/down counter, digital time display means for displaying a time signal, manually controlled display selecting means for connecting said first and second time counting means alternatively with said display means for displaying said first time signal or said second time signal respectively, manually controlled means for amending the count of said first time counting means, manually controlled means for amending the count of said second time counting means selectively to increase the count or to decrease the count of said second time counting means, and means for connecting said second time counting means with said first time counting means to transfer the time signal of said first time counting means to said second time counting means.

2. A digital electronic timepiece according to claim 1, further comprising manually controlled means for resetting said dividing means.

3. A digital electronic timepiece according to claim 1, comprising manually controllable electronic switching means for connecting each of said time counting means with said dividing means and said amending means.

4. A digital electronic timepiece according to claim 1, in which said display selecting means comprises electronic switching means for selectively connecting said first and second time counting means with said display means and manual switch means controlling sid electronic switching means.

5. A digital electronic timepiece according to claim 1, which each of said first and second time counting means comprises a ten minutes counter, an hour counter and a twelve hours counter.

* * * * *